US011122348B2

(12) United States Patent
D'Ascanio et al.

(10) Patent No.: US 11,122,348 B2
(45) Date of Patent: Sep. 14, 2021

(54) OUTDOOR OMNI BOLLARD SPEAKER

(71) Applicants: Franco L. D'Ascanio, Key Colony Beach, FL (US); Nicholas A D'Ascanio, Key Colony Beach, FL (US); Sean P Snowden, Marathon, FL (US)

(72) Inventors: Franco L. D'Ascanio, Key Colony Beach, FL (US); Nicholas A D'Ascanio, Key Colony Beach, FL (US); Sean P Snowden, Marathon, FL (US)

(73) Assignee: COASTAL SOURCE, LLC, Marathon, FL (US)

( * ) Notice: Subject to any disclaimer, the term of this patent is extended or adjusted under 35 U.S.C. 154(b) by 255 days.

(21) Appl. No.: 16/578,525

(22) Filed: Sep. 23, 2019

(65) Prior Publication Data

US 2020/0100006 A1 Mar. 26, 2020

Related U.S. Application Data

(60) Provisional application No. 62/736,189, filed on Sep. 25, 2018.

(51) Int. Cl.

| | |
|---|---|
| ***H04R 1/02*** | (2006.01) |
| ***H04R 1/20*** | (2006.01) |
| ***H04R 9/06*** | (2006.01) |
| ***H04R 5/02*** | (2006.01) |

(52) U.S. Cl.
CPC ..... *H04R 1/025* (2013.01); *H04R 5/02* (2013.01); *H04R 9/06* (2013.01); *H04R 2400/11* (2013.01)

(58) Field of Classification Search
CPC . H04R 1/025; H04R 5/02; H04R 9/06; H04R 2400/11; H04R 1/20; H04R 2201/40
USPC ..... 381/336, 335, 332
See application file for complete search history.

(56) References Cited

U.S. PATENT DOCUMENTS 3,135,348 A * 6/1964 Bill ..... H04R 1/26 181/147
9,004,706 B1 * 4/2015 Banfield ..... F21V 33/0056 362/86

* cited by examiner

*Primary Examiner* — Paul Kim
*Assistant Examiner* — Ubachukwu A Odunukwe
(74) *Attorney, Agent, or Firm* — Stuart M Goldstein

(57) ABSTRACT

An omni, bollard speaker has circular, cylindrical lower and upper housings. A domed driver is mounted within the top wall of the lower housing and a speaker is rotatably mounted in the internal space in the upper housing, between the top wall of the lower housing and the speaker cover of the upper housing. The speaker is rotatable from a first horizontal position directly over the domed driver to reflect wide dispersion acoustical output directly over the driver to disburse sound evenly within the listening area. The speaker can be quickly rotated downward and converted from this down-firing omni reflecting position to a side firing position or an up-and-out, direct radiating position. Thus, the same speaker serves many different sound coverage applications and can be customized on site for best use.

14 Claims, 1 Drawing Sheet

OUTDOOR OMNI BOLLARD SPEAKER

RELATED APPLICATION

The application claims the benefit of provisional application, 62/736,189, filed on Sep. 25, 2018.

BACKGROUND OF THE INVENTION

Prior outdoor omni speakers have tried to force, bend, and redirect the sound of traditional, protected drivers in order to provide clear, unforced output sounds to a wide disbursement range. Unfortunately, these output sounds are tortured, as they travel various roundabout paths to the listeners' ears. Such sounds are distorted, faint, and generally unsatisfactory.

SUMMARY OF THE INVENTION

Rather than positioning typical speakers in a protective, but seriously compromised acoustic position, it is the object of the present invention to provide an omni bollard speaker which configures special custom drivers in the position in which they sound the best, creating a system that defies convention.

This and other objects are accomplished by the present invention, an omni, bollard speaker comprising circular, cylindrical lower and upper housings. A domed driver is mounted within the top wall of the lower housing and a speaker, such as a high-powered, high-frequency ribbon tweeter or mid-range or full range speaker, is rotatably mounted in the internal space in the upper housing, between the top wall of the lower housing and the speaker cover of the upper housing. The speaker is rotatable from a first horizontal position directly over the domed driver to reflect wide dispersion acoustical output directly over the driver to disburse sound evenly within the listening area. The speaker can be quickly rotated downward and converted from this down-firing omni reflecting position to a side firing position or an up-and-out, direct radiating position. Thus, the same speaker serves many different sound coverage applications and can be customized on site for best use.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
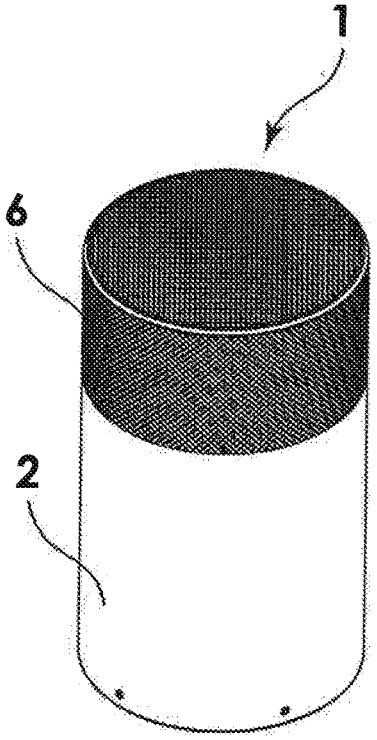
FIG. 1 shows a perspective view of the omni bollard speaker of the present invention.
Figure 2:
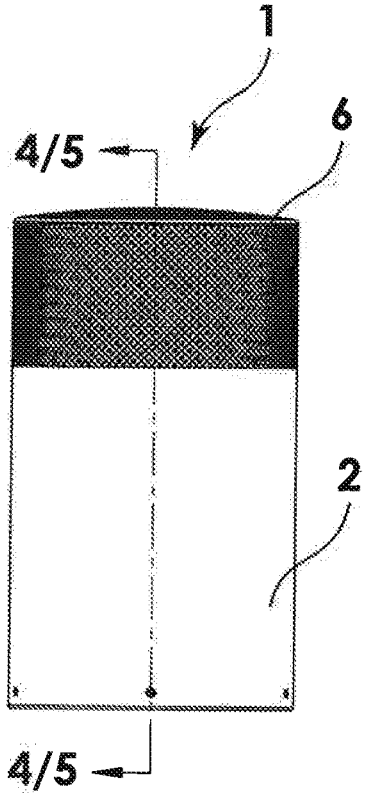
FIG. 2 shows a front view of the omni bollard speaker of the present invention.
Figure 3:
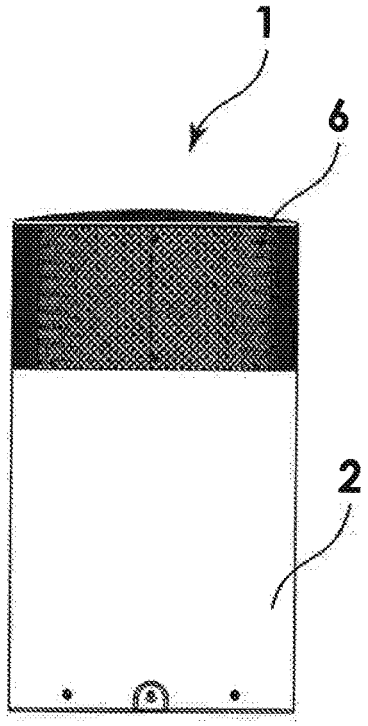
FIG. 3 shows a rear view of the omni bollard speaker of the present invention.

Omni bollard speaker 1 comprises circular, cylindrical lower housing 2 having top wall 4, and circular, cylindrical upper speaker housing 6 positioned over and attached to the lower housing. Upper housing 6 has speaker cover 8 with top surface 10 and bottom surface 12. Internal space 14 is located between bottom surface 12 of speaker cover 8 and top wall 4 of lower housing 2.

Figure 4:
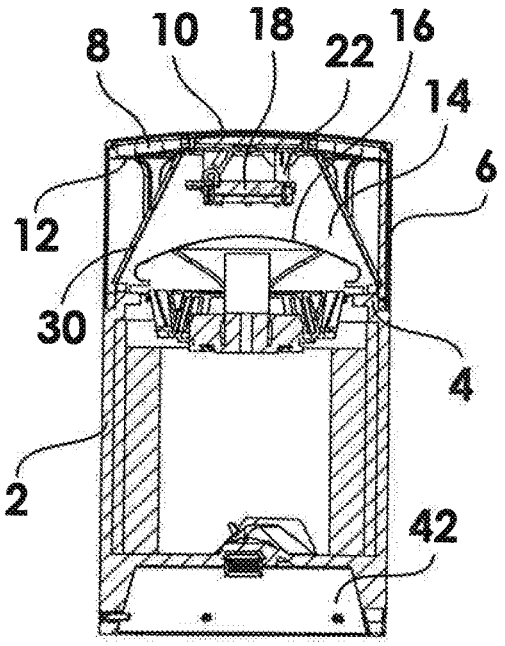
FIG. 4 shows a section view of the omni bollard speaker of the present invention, taken from FIG. 2, with its rotatable speaker in the down-firing position.
Figure 5:
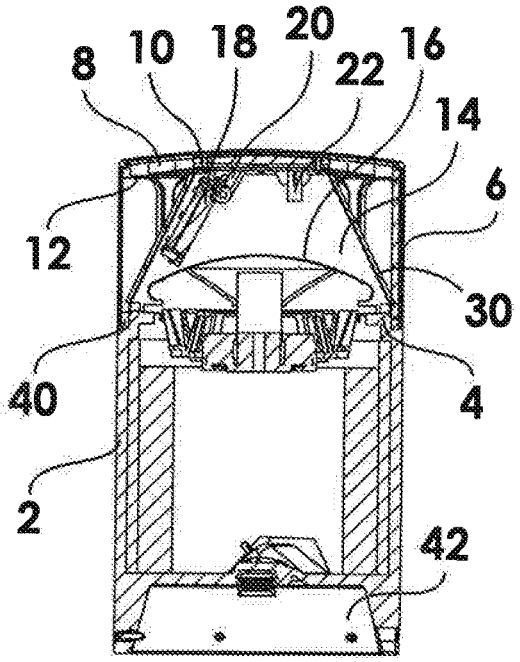
FIG. 5 shows a section view of the onmi bollard speaker of the present invention taken from FIG. 2 showing the rotatable speaker in the angled, up-and-out, direct radiating position.

Domed driver 16 is mounted within top wall 4 of lower housing 2, such that it faces upward, towards the listener. Powerful, high frequency ribbon tweeter, or any type of mid-range or full range speaker 18, located within internal space 14, is rotatably mounted to bottom surface 12 of speaker cover 8 by means of hinge member 20. Hinge member 20 permits speaker 18 to be rotatable from a first, horizontal position directly over domed driver 16, secured therein by bracket 22, as seen in FIG. 4, to a second angled position, laterally of the domed driver, as seen in FIG. 5.

In its first, horizontal position, speaker 18, reflects wide dispersion acoustical output directly off of domed driver 16 to disperse the sound evenly within the listening area. Active driver reflection is made possible by reflecting the high frequencies off the active moving driver, yielding a 360-degree output sound pattern in a very compact speaker system.

When a directional sound field is preferred for a longer throw in one direction, speaker 18 can be converted within minutes from the down-firing omni reflecting position to a different direction, i.e. an up-and-out, direct radiating position. Speaker 18 could also be angled for side firing reflection off domed driver 16. Thus, the same speaker serves many different sound coverage applications and thus can be customized on site for its best use in each area and every application.

Laminar flow conical, grill and drainage system 30 comprises a four-layer sandwich grill system to protect the drivers from performance damaging UV, water, dust, impurities, corrosion, and to keep water and ice from collecting in the up-firing speaker. Grill and drainage system 30 is built with a top external perforated grill that rejects particulate debris. The secondary internal conical filter grill consists of a 3-layer grill system of waterproof fabric laminated to a reticulated foam backed by a perforated support grill. The filter grill is specifically angled to reject small particulates along with capturing water and draining it away from the working components of the speaker system.

Lighting is made possible via optional LED module 40 that can provide ambient or task lighting.

The extremely low visual foot print of the speaker, contemplated to be only 10 inches in diameter and 8 inches in height, makes it blend in and disappear into the landscape, leaving only its sound to attract attention.

Many installation techniques are possible due to the speaker's ability to be buried directly into the ground, with or without a landscape stake for stability and theft prevention. A recessed hardscape bracket 42 allows for mounting to hardscape surfaces.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An omni bollard speaker comprising:

a circular, cylindrical lower housing having a top wall, a circular, cylindrical upper speaker housing positioned over and attached to the lower housing, the upper housing having a speaker cover with a top surface and a bottom surface;

an internal space located between the bottom surface of the speaker cover and the top wall of the lower housing;

a domed driver mounted within the top wall of the lower housing; and a speaker rotatably located within the internal space and mounted to the lower surface of the speaker cover of the upper housing, the speaker being rotatable from a first, horizontal position directly over the domed driver, to a second, angled positioned, laterally of the domed driver, wherein when the speaker is in the first position, the speaker reflects its sound dispersion downward, directly off the domed driver, and when the speaker is in the second position, sound dispersion output is provided in a different direction through the upper housing.

2. The omni bollard speaker as in claim 1 wherein the speaker is rotated between its first and second positions by a hinge member connected to the speaker and the bottom surface of the speaker cover of the upper housing.

3. The omni bollard speaker as in claim 1 further comprising a bracket to secure the speaker in its first position.

4. The omni bollard speaker as in claim 2 further comprising a bracket to secure the speaker in its first position.

5. The omni bollard speaker as in claim 1 further comprising a laminar flow grill and drainage system located within the internal space.

6. The omni bollard speaker as in claim 5 wherein the laminar flow grill and drainage system comprises a layered sandwich grill system to protect the speaker and domed driver from performance damaging UV, water, dust, impurities, corrosion, and to prevent water and ice collection around the speaker.

7. The omni bollard speaker as in claim 5 wherein the laminar flow grill and drainage system is conical in shape.

8. The omni bollard speaker as in claim 7 wherein the laminar flow grill and drainage system comprises a layered sandwich grill system to protect the speaker and domed driver from performance damaging UV, water, dust, impurities, corrosion, and to prevent water and ice collection around the speaker.

9. The omni bollard speaker as in claim 1 wherein in the first position, the speaker is down-firing to reflect wide sound output directly off the domed driver.

10. The omni bollard speaker as in claim 9 wherein in the second position, the speaker is in an up-and-out, direct radiating position.

11. The omni bollard speaker as in claim 9 wherein in the second position, the speaker is angled so that it is side-firing to reflect off the domed driver.

12. The omni bollard speaker as in claim 1 wherein the speaker is a high frequency ribbon tweeter.

13. The omni bollard speaker as in claim 1 wherein the speaker is a mid-range speaker.

14. The omni bollard speaker as in claim 1 wherein the speaker is a full range speaker.

* * * * *